United States Patent [19]

Dosch et al.

[11] Patent Number: 4,936,744

[45] Date of Patent: Jun. 26, 1990

[54] CENTRIFUGAL PUMP

[75] Inventors: Joseph B. Dosch, Auburn; Charles A. Cappellino, Seneca Falls; George Wilson, Skaneateles; James C. Osborne, Seneca Falls, all of N.Y.

[73] Assignee: Goulds Pumps, Incorporated, Seneca Falls, N.Y.

[21] Appl. No.: 384,787

[22] Filed: Jul. 25, 1989

[51] Int. Cl.[5] ..... F03B 11/04; F04D 1/10

[52] U.S. Cl. ..... 415/169.1; 415/143; 415/24

[58] Field of Search ..... 415/168.1, 169.1, 169.2, 415/170.1, 171.1, 17, 24, 51, 172.1, 179, 198.1; 416/179, 181, 182, 184, 223 R, 223 B

[56] References Cited

U.S. PATENT DOCUMENTS

| | | | |
|---|---|---|---|
| 1,101,493 | 6/1914 | Houghton | 55/407 |
| 1,813,747 | 7/1931 | Kirgan | 415/24 |
| 3,137,237 | 6/1964 | Zagar et al. | 415/171.1 |
| 3,213,794 | 10/1965 | Adams | 416/181 |
| 3,230,890 | 1/1966 | Yokota et al. | 415/24 |
| 3,282,217 | 11/1965 | Slover et al. | 137/392 |
| 3,362,132 | 1/1968 | Schellenberg | 55/21 |
| 3,944,406 | 3/1976 | Jaqusch et al. | 55/407 |
| 4,190,396 | 2/1980 | Tomioka et al. | 415/170.1 |
| 4,273,562 | 6/1981 | Niskanen | 415/169.1 |
| 4,410,337 | 10/1983 | Gullichsen et al. | 55/21 |
| 4,435,193 | 3/1984 | Gullichsen et al. | 55/21 |
| 4,675,033 | 6/1987 | Fellman et al. | 55/203 |
| 4,776,758 | 10/1988 | Gullichsen | 415/169.1 |
| 4,780,053 | 10/1988 | Gullichsen | 415/143 |
| 4,826,398 | 5/1989 | Gullichsen | 415/143 |
| 4,854,819 | 8/1989 | Gullichsen | 415/143 |

FOREIGN PATENT DOCUMENTS

| | | | |
|---|---|---|---|
| 1158570 | 12/1983 | Canada | 183/11 |

*Primary Examiner*—Carl D. Price
*Assistant Examiner*—Hoang Nguyen
*Attorney, Agent, or Firm*—Bean, Kauffman & Spencer

[57] ABSTRACT

The invention relates to a centrifugal pump of the type adapted for use in pumping multiple phase liquids, i.e. liquids having entrained gas and liquids having both entrained gas and solids. The pump includes means for effecting an initial separation of gas from the liquid, as by centrifugal action, and a final separation by means of a unique pump-out mechanism disposed rearwardly of a shroud of an impeller of the pump and including pump-out vanes and a repeller shroud cooperating with the impeller shroud and pump-out vanes to define radially opening flow paths, wherein flow openings extend across the impeller shroud for flow communication with the radially opening flow paths. The mechanism may also include repeller vanes carried by the repeller shroud to extend rearwardly of pump-out vanes.

32 Claims, 3 Drawing Sheets

CENTRIFUGAL PUMP

BACKGROUND OF THE INVENTION

The invention relates to centrifugal pumps adapted for use in pumping liquids having a gas content, and more particularly to centrifugal pumps adapted to effect removal of gas from a pumped liquid in order to improve pump performance or processing of the pumped liquid.

It is well known that the presence of a gas, such as air, in a pumped liquid may tend to decrease the hydraulic efficiency of a centrifugal pump, and that gas separated from the pumped liquid may collect in sufficient quantity adjacent the front of the hub or eye of the pump's impeller, as to cause the output of the pump to cease. Separation of gas from the pumped liquid may be due to centrifugal action imparted to the liquid by the pumping vanes of an impeller of the pump or at a point upstream of the impeller adjacent the suction inlet of the pump, such as for instance where it is necessary to employ a separate fluidizer or centrifuge to fluidize or render free flowing a high consistency fibrous pulp suspension for pumping purposes.

It is also known that gas tending to collect in proximity to the hub of the impeller of a centrifugal pump may be removed by providing a flow path defined by flow openings arranged to extend through a shroud or hub of the impeller for purposes of placing front and rear surfaces of the impeller in flow communication; a vent chamber opening through a rear wall of a pumping chamber of the pump adjacent an impeller drive shaft for receiving gas passing through the flow openings and a vent conduit for placing the vent chamber in flow communication with a gas receiving or collecting reservoir, such as the atmosphere, either directly or via an auxiliary vacuum pump, depending on the difference between the suction head, i.e. the pressure existing at the suction inlet of the pump, and the pressure of the gas receiving reservoir. In that there is rarely complete separation of gas from liquid at that point adjacent the front of the impeller with which the flow openings communicate, there is a tendency for a quantity of liquid to escape with the gas through the flow openings, and for this reason it is common practice to provide pump-out vanes on the rear surface of the impeller shroud, which are intended to preferentially act on the liquid component of the gas-liquid mixture passing through the flow openings for purposes of pumping same to the discharge of the pump and thus prevent passage of liquid from the pumping chamber into the vent conduit. Prior pumps of this general type are disclosed for example in U.S. Pat. Nos. 1,101,493; 3,944,406; 4,410,337 and 4,435,193, and Canadian Pat. No. 1,158,570.

It has also been proposed, as in U.S. Pat. No. 3,230,890, to provide an auxiliary pump or centrifugal separator for separating gas from liquid escaping from the pumping chamber of a centrifugal pump.

Under certain steady state conditions, a centrifugal pump fitted with properly sized pump-out vanes may be operated to effect removal of gas in quantities sufficient to permit the pump to operate at an efficiency level corresponding to that characteristic of pump operation with liquid having essentially no gas content without loss of liquid through the vent conduit.

In actual practice, steady state pump inlet conditions are rarely encountered and slight changes in the pressure differential existing across the pump from some predetermined value will either adversely affect the efficiency of a centrifugal pump or allow for loss of liquid through the vent conduit. For example, if the pressure differential across the pump should decrease, due to either a decrease of the suction head and/or an increase in pressure in the gas receiving reservoir, there would be a reduction in the amount of gas removed from the pumped liquid and this would result in a reduction in pump efficiency. There would, however, be no loss of liquid through the vent conduit. Conversely, if the pressure differential across the pump should increase, due either to an increase in suction head or a reduction in pressure in the gas receiving reservoir, pump efficiency would remain essentially the same, but liquid would escape through the vent conduit.

In that in practice it is difficult or impossible to provide a constant suction head and ensure that liquid to be pumped has a uniform gas content, it has been proposed for instance in U.S. Pat. Nos. 3,944,406; 4,410,337 and 4,435,193 and Canadian Pat. No. 1,158,570 to arrange a gas flow control valve in the vent conduit leading to a constant speed vacuum pump and to continuously adjust the valve in a manner determined by sensed changes in various pump operating parameters in an attempt to vary the pressure drop across the pump as required to maximize pump efficiency, while avoiding loss of pumped liquid through the vent conduit.

SUMMARY OF THE INVENTION

The present invention is directed towards an improved centrifugal pump particularly adapted for use in pumping multiple phase liquids, i.e. liquid having entrained gas and liquids having entrained gas and solids, without requiring precise control of the pressure drop across the pump.

A pump formed in accordance with the present invention is of conventional construction from the standpoint that it includes a housing defining a pumping chamber having an axially opening suction inlet and a radially opening discharge outlet; an impeller mounting for rotation within the pumping chamber by a drive shaft, which is aligned with the suction inlet and arranged to extend rearwardly of the impeller through an opening formed in a rear wall of the pumping chamber; and a gas removal system for removing gas tending to collect within the pumping chamber rearwardly of the impeller. More specifically, the impeller includes a shroud extending radially of the drive shaft and having flow openings extending between front and rear surfaces thereof; pumping vanes carried by the front surface of the shroud for pumping liquid between the suction inlet and discharge outlet; and pump-out vanes carried by the rear surface of the shroud for pumping liquid passing rearwardly of the impeller through the flow openings for discharge through the discharge outlet. The gas removal system includes a vent chamber opening through the rear wall of the pumping chamber annularly of the drive shaft, a vacuum pump, a gas vent conduit connecting the vent chamber to the vacuum pump, and a gas flow control valve arranged in the gas discharge conduit for varying the pressure within the vent chamber. Where the pump is intended to pump liquids from which gas is difficult to extract by reliance only upon the centrifugal action of the impeller, such as for the case of relatively high consistency fibrous suspension and relatively homogeneous liquid-gas mixtures, a fluidizer or centrifuge may be fitted on the drive shaft forwardly of the impeller to aid in separation of gas from the suspension or mixture under centrifugal action and the collection thereof in a core or "gas bubble" forwardly of the eye of the impeller.

In accordance with the present invention, an impeller to be employed in a centrifugal pump is fitted with a repeller shroud mounted to extend radially from the hub of an impeller and cooperates with its shroud and pump-out vanes to define radially extending flow paths communicating with flow openings extending through the impeller shroud for purposes of imparting a well defined radial flow component to gas and liquid passing rearwardly of the impeller through the flow openings. The repeller shroud may be fitted with rearwardly extending repeller vanes adapted to project into an annular chamber formed in a rear wall of a pumping chamber of the pump concentrically outwardly of its vent chamber.

In the practice of the invention, it is required that the repeller shroud be of a diameter which at least equals and preferably exceeds the diameter of the vent chamber and the radial position of rear ends of the flow openings at the point they enter the flow paths, but which is less than the diameter of the pump-out vanes and impeller shroud. In turn, the diameters of the pump-out vanes and the impeller shroud must equal or exceed the diameter of the pumping vanes of the impeller for purposes of generating a head no less than that generated by the pumping vanes.

The utilization of an impeller modified in accordance with the present invention allows an otherwise conventional centrifugal pump to be employed for example in a typical pulp mill installation for pumping a high consistency fibrous suspension from a reservoir subject to variation in suspension level at maximum pump efficiency and with no loss of suspension through the vent conduit of the pump without requiring continuous adjustments of the pressure differential across the pump.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
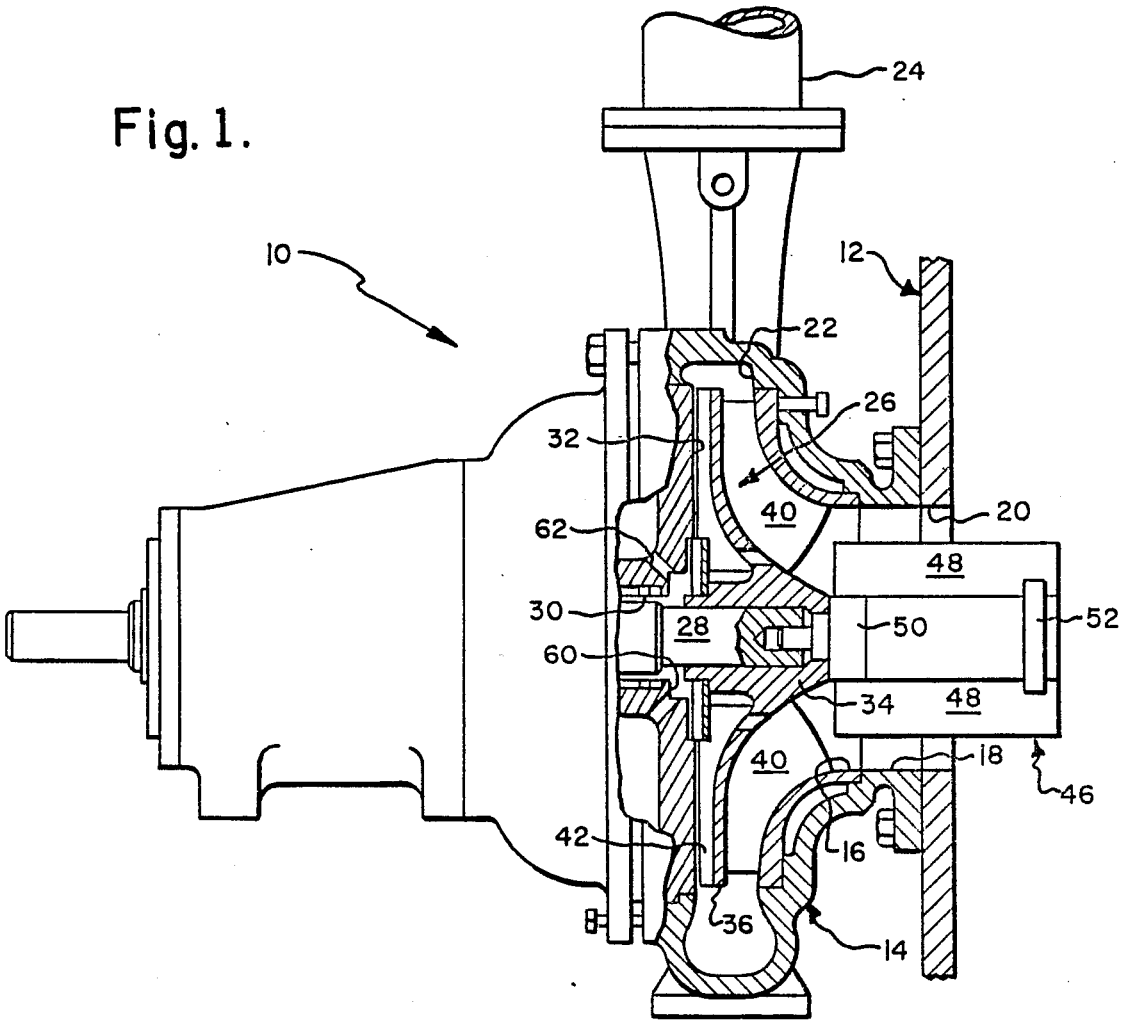
FIG. 1 is a view of a pump incorporating the present invention.

Reference is first made to FIG. 1, wherein a pump formed in accordance with the present invention is generally designated as 10 and shown in association with a reservoir, such as a standpipe 12, from which a liquid is to be pumped. Pump 10 generally includes a housing 14 defining a pumping chamber 16 having an axially opening suction inlet lB communicating with an outlet opening 20 formed in standpipe 12 and a radially opening discharge outlet 22 connected to a discharge conduit 24; and an impeller 26 mounted for rotation within the pumping chamber by a drive shaft 28, which is axially aligned with the suction inlet opening and extends rearwardly of the impeller through an opening 30 in a rear wall 32 of the pumping chamber for connection with a suitable motor, not shown.

Figure 3:
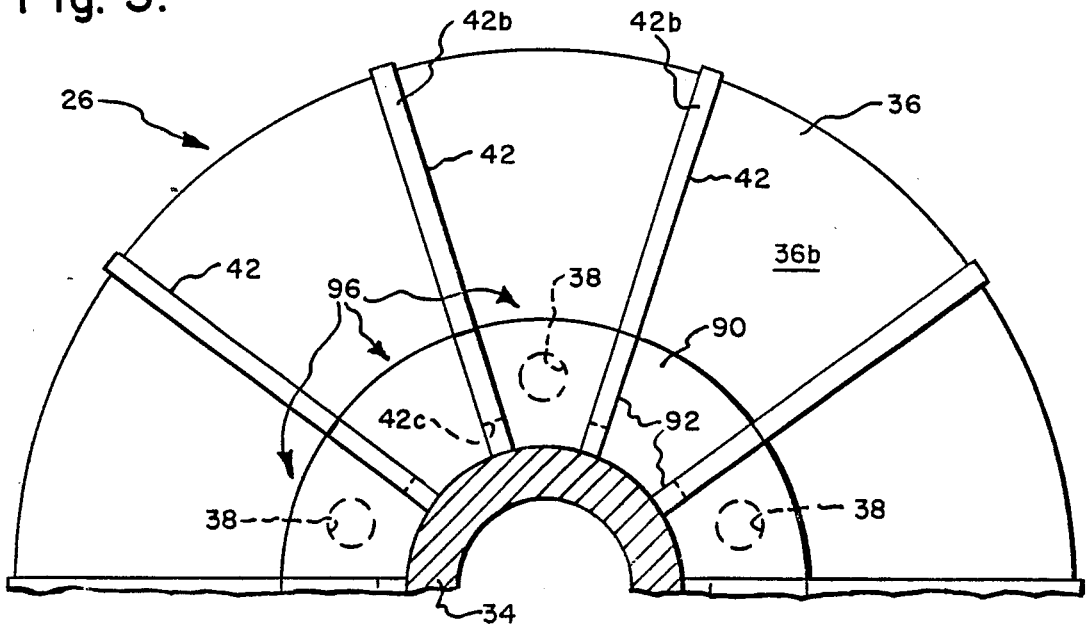
FIG. 3 is a sectional view taken generally along the line 3—3 in FIG. 2.
Figure 2:
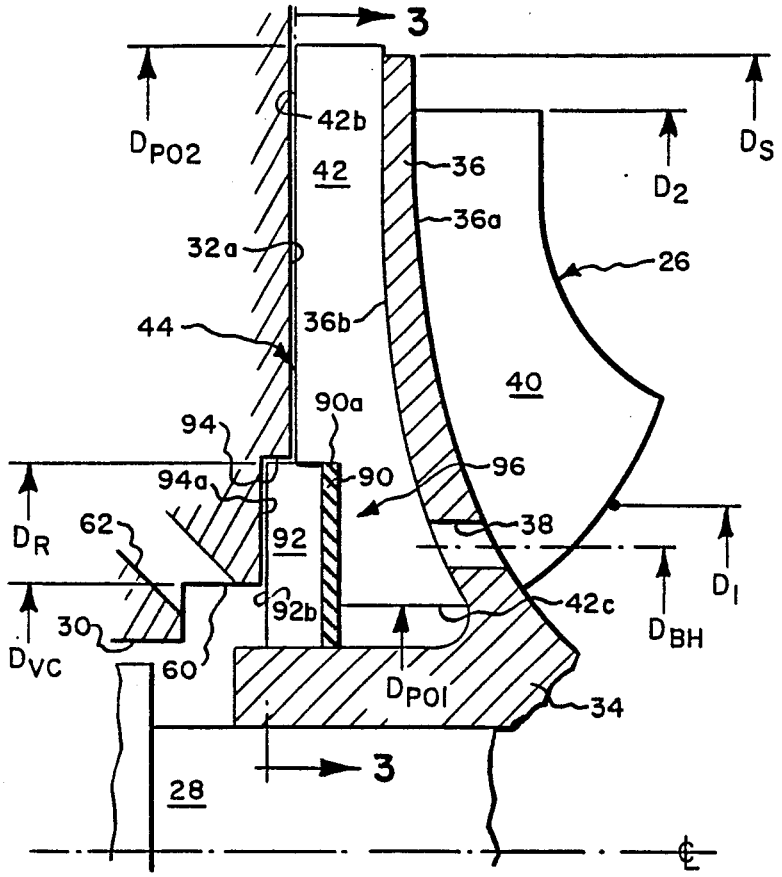
FIG. 2 is a partial sectional view of an impeller employed in the practice of the present invention.

Impeller 26 is shown in FIGS. 1–3 as including a central hub 34 mounting a radially extending impeller shroud 36 having front surface **36*a* and a rear surface 36*b* arranged to face towards suction inlet 18 and pumping chamber rear wall 32, respectively; at least one and preferably a plurality of flow openings 38 extending between the front and rear surfaces of the shroud; a plurality of pumping vanes 40 carried by the front surface of the shroud for pumping liquid from suction inlet 18 to discharge outlet 22; and a plurality of pump-out vanes 42 for pumping liquid passing rearwardly of the impeller through the flow openings radially towards the discharge outlet. The diameters $D_{P02}$, $D_s$ and $D_2$ of pump-out vanes 42, shroud 36 and pumping vanes 40, respectively, have the relationship of $D_{P02} \geqq D_s \geqq D_2$. Diameters $D_{P02}$ and $D_S$ are preferably greater than $D_2$, but pump-out vanes 42 may otherwise be of a number, axial dimension and shape to ensure that the head generated by the pump-out vanes will equal and preferably exceed the head generated by the pumping vanes in order to prevent flow of pumped liquid towards the rear of impeller 26 about the periphery of shroud 36. In that the head generated by pump-out vanes 42 decreases, as the axial gap or spacing 44 between the radial surface 32*a* defined by rear wall 32 and the rear edges 42*b* of pump-out vanes 42** increases, as for instance would be the case when the impeller is moved forwardly within the pumping chamber to accommodate for wear, it is desirable to initially maintain the gap as small as possible, such as for example on the order of between 0.015 and 0.050 inch.

For those instances where pump 10 is employed to pump liquids from which entrained gases are not readily removed or separated from the liquid solely by the centrifugal action imparted to the liquid by impeller 26, such as for the case of high consistency fibrous suspensions and certain homogeneous liquid-air mixtures, it is necessary to impart rotation to the liquid upstream of the impeller, such as by means of a fluidizer or centrifuge 46 conveniently mounted for rotation with the impeller. Fluidizer 46 may consist of a plurality of radially extending blades 48 interconnected at their radially inner edges and adjacent their rear and leading ends by a mounting ring or plate 50 and a connecting or stabilizing ring 52. Blades 48 may be straight or curved in a direction extending axially of shaft 18 depending upon whether it is desired to impart only radially directed or both radially and axially directed forces to the liquid to be pumped. The axial length of blades 48 may vary depending upon the nature of the liquid to be pumped, but when the pumped liquid is a high consistency fibrous suspension, it is preferable to size the blades to project into the confines of standpipe 12, as shown in FIG. 1, in order to ensure fluidization of the fibrous suspension prior to entry thereof into suction inlet 18. In any case, blades 48 are intended to act on the liquid to be pumped in a manner providing for separation of gas from the liquid and allow the gas to concentrate or collect in a core area of pumping chamber 16 in front of impeller 26 and adjacent to its axis of rotation. Gas or liquid rich in gas then is allowed to pass through flow openings 38 whereupon it is subjected to centrifugal action imparted by pump-out vanes 42 to allow gas to collect adjacent shaft 28 and any liquid passing through the flow opening to be forced outwardly towards discharge opening 22.

Figure 6:
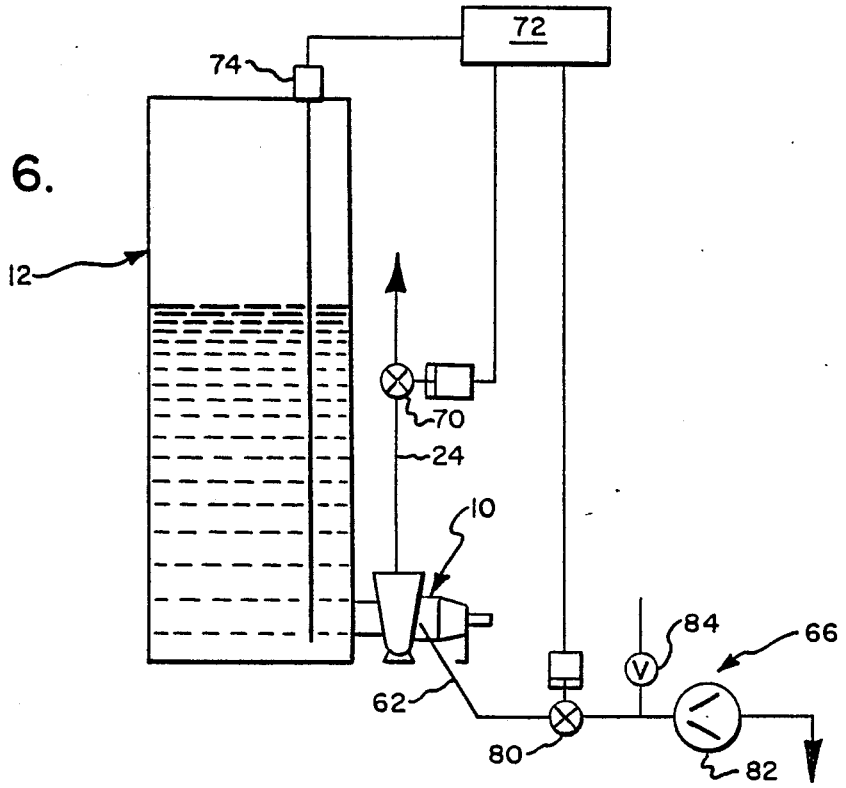
FIG. 6 is a diagrammatic view of a control system adapted for use with the present pump.

An enlarged vent chamber 60 defined by an annular recess opening through pumping chamber rear wall 32 adjacent shaft opening 30 provides a space for accumulating gas tending to collect rearwardly of impeller 26 and gas may be withdrawn from the vent chamber by a vent conduit 62 for delivery to a suitable gas collection reservoir, either directly or indirectly, via a gas removal system of the general type designated as 66 in FIG. 6.

It is desirable to prevent pump 10 from running dry, and accordingly for installations subject to substantial, periodic changes in suction head, e.g. the height of liquid in standpipe 12 above suction inlet 18, discharge conduit 24 would be provided with a liquid flow control valve 70 operated by a signal(s) from a programmable controller 72 in response to the level of liquid within the standpipe, as sensed by a suitable level measuring or sensing device 74. Under normal operating conditions, flow control valve 70 would be adjusted in a manner tending to maintain the height of liquid within standpipe 12 at some predetermined value.

In the gas removal system 66 shown in FIG. 6, gas vent conduit 62 communicates with a suitable gas collection reservoir, not shown, such as the atmosphere for the case where the gas to be removed is air, and a gas flow control valve 80 and a motor powered vacuum pump 82 are connected thereinto. Where the withdrawn gas is air, a vacuum regulator, such as may be defined by a manually adjustable atmosphere air bleed valve 84, may be connected into conduit 62 immediately upstream of vacuum pump 82 to permit the vacuum pump to be run continuously when gas control valve 80 is closed.

The construction and mode of operation of pump 10, as thus far described, is conventional and known to be alternatively subject to loss in pumping efficiency or leakage of pumped fluid through vent conduit 62 incident to variation in operating conditions of the pump, such as variations in suction head and gas content of the liquid to be pumped, in the absence of precise control of the pressure differential existing across the pump, such as by precise adjustments of the setting of gas flow control valve 80, or alternatively, the operating conditions of vacuum pump 82.

In accordance with the present invention, an otherwise conventional pump 10 is modified to permit efficient pump operation in the absence of loss of pumped liquid through vent conduit 62 over a substantial range of pump operating conditions without requiring precise control of the pressure differential existing across the pump.

More specifically, the invention contemplates an improved impeller construction, which is shown in FIG. 2 for the case of a partially open impeller as including a repeller shroud 90 arranged to extend radially from hub 34 rearwardly of impeller shroud 36 and a plurality of repeller vanes 92 arranged rearwardly of the repeller shroud and to project rearwardly beyond rear edges **42*b* of pump-out vanes 42 for receipt within an additional annular chamber 94 opening through pumping chamber rear wall 32 concentrically outwardly of vent chamber 60**.

Repeller shroud 90 is required to be sized and arranged, such that it cooperates with impeller shroud rear surface **36*b* and the inner ends 42*c* of pump-out vanes 42 to provide a plurality of well defined radial flow paths 96, which receive gas and liquid passing through the rear ends of flow openings 38 and then serve to propel same radially outwardly of the flow openings towards discharge outlet 22. Thus, the diameter $D_R$ of repeller shroud 90 is required to be no less than $D_{BH}$ and preferably to exceed the latter sufficiently to ensure that all materials passing through flow openings 38 are caused to experience radial acceleration prior to reaching the outer rim 90*a* of the repeller shroud. Diameter $D_R$ is also required to equal and preferably exceed the diameter $D_{VC}$ of vent chamber 60, and for the construction shown in FIG. 2 would preferably correspond essentially to the diameter of additional chamber 94. Where pump-out vane rear edges 42*b* are required to cooperate with rear surface 32*a* for head generation purposes, $D_R$ should not exceed a value required to properly define flow paths 96, since otherwise the presence of repeller shroud 90 would diminish the head producing capability by pump-out vanes 42. The axial spacing between repeller shroud 90 and rear edges 42*b* of pump-out vanes 42, and thus rear surface 32*a*, does not appear to be critical, so long as it is sufficient to permit free passage of gas over rim 90*a* and then radially inwardly towards vent chamber 60**.

Repeller vanes 92 are shown in FIGS. 2 and 3 as having rear edges **92*b* spaced from the rear wall 94*a* of chamber 94 by an amount corresponding essentially to gap 44, and as being arranged to extend radially of hub 34 in alignment one with each of pump-out vanes 42**.

Flow openings 38 must be spaced radially of the axis of rotation of impeller 26 such that they are located at a diameter $D_{BH}$, which does not exceed the value of $$\frac{D_1 + D_2}{2},$$

wherein $D_1$ and $D_2$ are the mean inlet and outlet diameters of pumping vanes 40. The shape, size, number and placement of flow openings 38 appear to be matters of choice depending on impeller design and pump requirements. However, flow openings 38 must be of sufficient overall area to allow for withdrawal of gas tending to collect forwardly of impeller 26 and individually be of sufficient size to minimize the likelihood of blockage by solids, if present in the liquid being pumped. Moreover, flow openings 38 would desirably be placed as close as possible to the rotational axis of impeller 26 and may pass through hub 34, and thus across impeller shroud 36, if allowed by the design and size of the impeller. In FIG. 3, flow openings 38 are shown as being placed in alignment with alternate flow paths 96 and with such flow paths arranged in communication adjacent hub 34 by spacing inner ends **42*c* of pump-out vanes 42** from the hub with a common inside diameter $D_{P01}$, which is preferably smaller than $D_{BH}$.

The operation of impeller 26 is essentially similar to a like sized/shaped standard impeller fitted with flow openings 38 and pump-out vanes 42, except that repeller shroud 90 blocks direct axial flow communication between the flow openings and vent chamber 60 and causes initial flow of all material passing through the flow openings to be directed radially outwardly along flow paths 96. By the time the flow of materials reaches rim **90*a*, it is sufficiently well defined to ensure that its heavy constituents, i.e. liquid and solids, if any, will tend to continue to move radially outwardly under the continuing influence of pump-out vanes 42 even though exposed to the reduced pressure condition present in vent chamber 60. However, the reduced pressure condition present in vent chamber 60 is sufficient to deflect the relatively lightweight gas constituent of the flow and cause same to pass around rim 90***a* for flow radially inwardly towards the vent chamber. Repeller vanes 92 function as a secondary centrifugal separator normally serving to radially expel droplets of liquid, which might be entrained in the separated gas, and when required serving to generate a head opposing inward flow of liquid towards the vent chamber.

Figure 4:
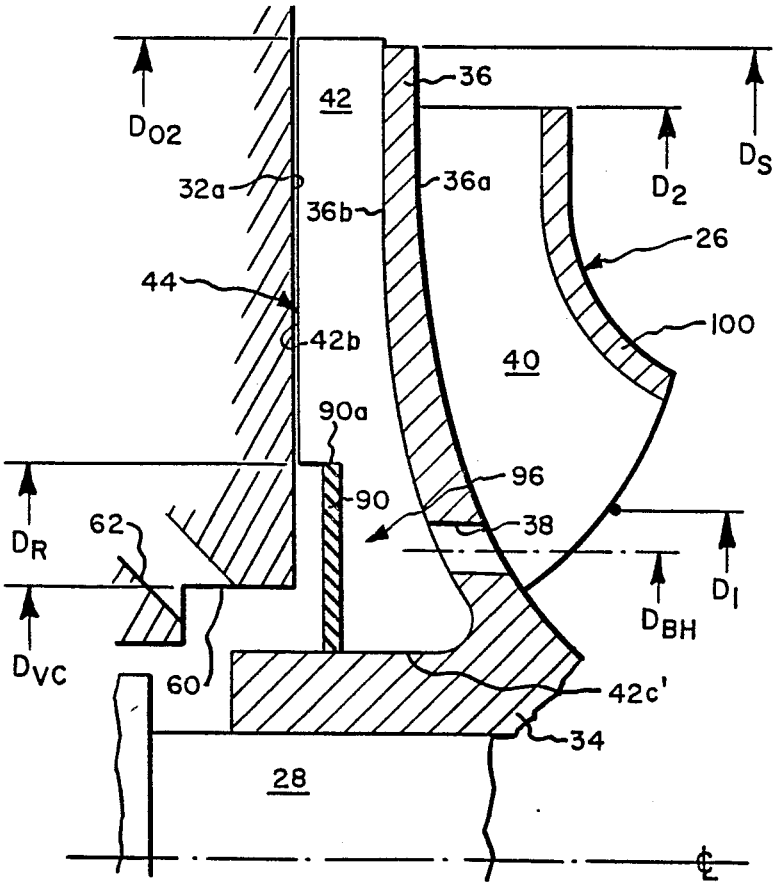
FIG. 4 is a view similar to FIG. 2, but showing a fully enclosed impeller.

FIG. 4 illustrates the utilization of the present invention in a fully enclosed impeller, that is, an impeller having a front shroud 98 connected to the leading edges of pumping vanes 40. With this type of impeller, forwardly directed adjustment of impeller 26 would normally not be required such that gap 44 would remain essentially constant during the operational life of pump 10. Thus, with this type of impeller, the need for providing separate repeller vanes 92 projecting rearwardly of pump-out vane rear edges 42*b* and into chamber 94 is avoided. The position of repeller shroud 90 axially of pump-out vanes is determined in large part by the size of gap 44. Thus, for a relatively small gap on the order of 0.015 inch, it would be preferable to position repeller shroud 90 slightly forwardly of pump-out vane rear edges 42*b*, as shown in FIG. 4, in order to provide sufficient clearance between the repeller shroud and rear wall surface 32*a* to allow unobstructed passage of air over rim 90*a* and radially inwardly toward vent chamber 60. On the other hand, for a relatively large gap on the order of about 0.050 inch, it may be possible to arrange the rear surface of the repeller shroud 90 essentially flush with vane rear edges 42*b*. FIG. 4 also illustrates an alternative pump-out vane construction, wherein the inner ends 42*c*′ of all of pump-out vanes 42 extend into contact with hub 34. With this type of construction, flow openings 38 may be of a number sufficient to permit one to communicate with each flow path 96. However, where the number of flow openings 38 allowed for instance due to the chosen number of pumping vanes 40 is not sufficient to supply each flow path 96, the flow openings may be arranged to connect with only alternate flow flow paths, as depicted in FIG. 3, for which case the unconnected flow paths serve only to generate head for pumpout purposes. Operation of the impeller depicted in FIG. 4 is similar to that shown in FIG. 2, except that repeller vanes need not be employed. Where the gap between repeller shroud 90 and rear wall surface 32*a* is maintained relatively small, the rear surface of the impeller is particularly effective in expelling droplets of liquid, which might be extrained with the separated gas passing inwardly towards vent chamber 60.

Figure 5:
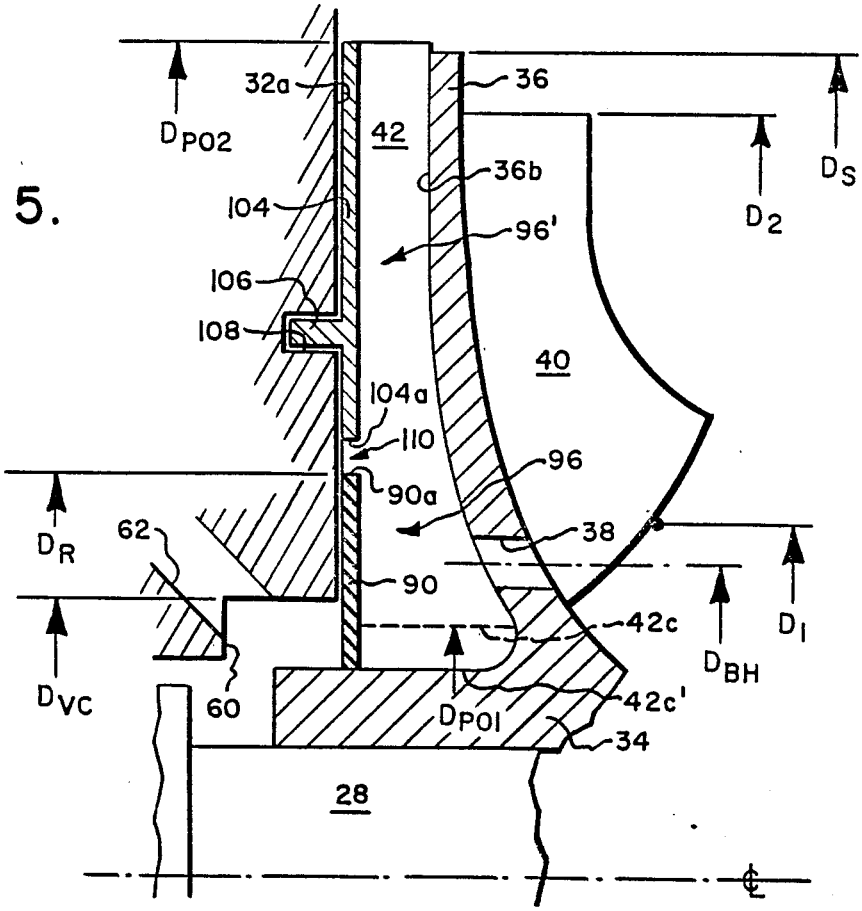
FIG. 5 is a view similar to FIG. 2, but showing a further alternative impeller construction.

FIG. 5 illustrates the utilization of the invention in a partially open impeller of the type permitting axial adjustments thereof without loss of head generated by pump-out vanes 42 by the expedient of attaching a further shroud 104 to the rear edges of the pump-out vanes and fitting such further shroud with a rearwardly projecting annular choke flange 106 closely received within an annular recess 108 opening through rear wall surface 32*a* to prevent flow of high pressure liquid inwardly past the choke flange. Choke flange 106 and recess 32*a* may be eliminated, if the impeller need not be axially adjusted and a relatively small gap or spacing can be maintained between the rear surface of such shroud and rear wall surface 32*a*. Further, shroud 104 cooperates with rear surface 36*b* of impeller shroud 36 and pump-out vanes 42 to define additional flow path 96′ disposed in alignment with flow paths 96, and has an inner rim 104*a* cooperating with repeller shroud outer rim 90*a* to define openings 110 facilitating escape of gas towards vent chamber 60. If desired, shrouds 90 and 104 may be of integral construction and openings 110 defined by suitably formed apertures.

FIG. 5 also illustrates an alternate pump-out vane construction, wherein the inner ends 42*c* of staggered ones of, i.e. alternate, pump-out vanes 42 are spaced from hub 34 and the inner ends 42*c*′ of intermediate pump-out vanes connect with hub 34, thus creating a pair of adjacent flow paths connected to a common flow opening. Operating characteristics of the impeller depicted in FIG. 5 are similar to those depicted in FIGS. 2 and 4.

Laboratory tests have been conducted using a standard 4×8–14 centrifugal pump manufactured by Goulds Pumps, Incorporated of Seneca Falls, N.Y. to pump water having 15% air content. The standard pump employed a semi-open impeller fitted with pump-out vanes and its vent chamber was exhausted directly to the atmosphere. It was determined that the pump was capable of generating a discharge head and flow rate comparable to that obtainable when pumping pure water and without loss of water through its vent conduit for a steady state condition where the pressure differential across the pump, i.e. the difference between the suction head or pressure existing at its suction inlet and the vent pressure existing in its vent chamber, was maintained equal to a reference value of about fifteen feet of water. It was observed that, when the pressure differential was decreased below the reference value, which may occur either as a result of a reduction in suction head or the introduction of a positive pressure in the vent chamber, a reduced quantity of air was vented from the pump, thereby causing the efficiency of the pump to fall below that obtainable when pumping pure water. On the other hand, when the pressure differential was increased about the reference value, which may occur either as a result of an increase in suction head or the introduction of a negative pressure in the vent chamber, the efficiency of the pump was comparable with that obtainable when pumping pure water, but a loss of water through its vent conduit was observed.

Tests were also conducted using a 4×8–14 pump fitted with an impeller modified in the manner depicted in FIG. 2 to pump water having a 15% air content connected into a supply providing a suction head of about fifteen feet. The vent conduit was connected to a vacuum pump and tests conducted to determine the effect of different pressure differentials across the pump. It was observed that the performance of the thus modified pump corresponded essentially to that of the standard pump for pressure differential conditions equal to and below the reference value of the standard pump. However, it was determined that the modified pump was capable of performing at an efficiency comparable to that obtainable when pumping pure water and without loss of water through its vent conduit for pressure differentials in a range exceeding the reference value by upwards of fifteen feet of water.

Standard centrifugal pumps may be readily adapted for use in pumping any given liquid having entrained gas under steady state conditions of suction head and gas content by simply ensuring that the pressure existing in its vent chamber is maintained at a constant value, which is correlated with a constant value of the suction head to maintain a pressure differential across the pump equal to some predetermined reference value at which the pump operates at maximum possible efficiency without loss of liquid through its vent conduit. The predetermined reference value would be expected to vary depending upon the type of liquid being pumped and the size and operating characteristics of the pump itself. However, for pump installations not enjoying steady state conditions, such as those encountered in pulp mills in connection with the pumping of high consistency fibre stock suspensions, it is necessary to provide a control for continuously varying the pressure existing in the vent chamber of a standard pump in an effort to maintain the pressure conditions across the pump at its predetermined reference value, as the available suction head raises and falls relative to some average design value.

As by way of illustration, in a typical pulp mill installation generally depicted in FIG. 6, suspension is fed at a variable rate to a suitable reservoir, such as standpipe 12 having a height for example on the order of about ten feet, as measured about the suction inlet of the pump; the discharge flow rat of the pump is controlled, as by adjustments of flow control valve 70, with a view towards maintaining the height of the suspension at some design value; and gas flow control valve 80 is adjusted as required to vary the pressure differential across the pump, in order to accommodate for increases and decreases of the height of the suspension relative to the design value. It has been observed that for the case where a standard pump is employed to pump high consistency fibrous suspensions of on the order of about 12%, vacuum pump 84 should be operated to provide a negative pressure in vent conduit 62 of about five feet of water for a design value or suspension height of five feet in order to provide a pressure differential across the pump, which appears to maximize pump efficiency without creating a loss of suspension through the vent conduit. While diverse types of controllers 72 are presently in use, a typical controller would be of the programmable variation, wherein the setting of liquid flow control valve 70 is determined by the height of suspension, as measured by sensor 74, as a function of time. For example, a set point, such as a suspension height of five feet, is established and when upon initially filling of standpipe 12 the suspension reaches five feet, valve 70 would start to open and thereafter might settle for movement within a range of 30% to 35% open condition as the suspension height varies between four and a half feet and five and a half feet. Valve 70 would typically open 100%, if the suspension height was to approach eight feet, and might become fully open at lesser suspension height under certain conditions. Valve 70 would be fully closed when the level of the suspension dropped to an undesired level, during an intended period of pump operation, or when the pump was shut down upon completion of an intended draining of the reservoir.

It is proposed to employ a pump modified in accordance with the present invention in a pulp mill installation of the type described and to modify operating conditions by reducing the negative pressure provided by vacuum pump 82 from five feet of water given in the above example to an arbitrary selected low value, such as ten feet of water, to allow pump operation throughout essentially the whole of possible variations of height of suspension within standpipe 12 without adjustments of gas control valve 80 other than alternatively placing same in fully open or fully closed condition incident to an arbitrarily selected setting of liquid control valve 70. Specifically, it is proposed to operate vacuum pump 84 at a negative pressure sufficient to create a pressure differential across the pump when the height of the suspension is at its design value, which exceeds the pressure differential required by the modified pump to maximize withdrawal of gas therefrom, whereby to permit the pump to operate at maximum efficiency throughout the range of obtainable suspension levels within standpipe 12 without loss of suspension through vent conduit 62.

To carry operation of the modified pump into effect, a relatively low liquid control valve setting, such as 20% open, may be selected on the basis that such setting would normally be encountered only during initial filling of standpipe 12 and subsequent emptying of such standpipe, as an incident to shutdown of operation, such as for maintenance purposes. Thus, it is contemplated that controller 72 would cause gas control valve 80 to be fully closed at the start-up of pump operation and to become fully open when liquid control valve 70 initially is opened to a setting of 20%, whereafter the gas control valve would remain fully open until the liquid control valve returned to a setting of 20% normally again encountered at the time of shutdown.

It is also contemplated that the modified pump may be employed in extremely tall reservoirs, wherein suspension levels typically exceed a range of between twenty-five and thirty-five feet at which the suction head is sufficient to reduce the amount of air separated from the suspension by the fluidizer to a point at which the air does not adversely effect operation of a centrifugal pump. When used in this type of installation, controller 72 would serve to effect closure of gas control valve 80 when the height of the suspension would be sufficient to produce a pressure differential across the pump at which suspension would otherwise be lost through vent conduit 62. Thus, for this type of installation, the modified pump would only serve to effect removal of gas during start-up and shutdown of the system.

The term liquid, as used herein and in the appended claims, is meant to include liquids having entrained gas and liquid having both entrained gas and solids, such as fibres.

What is claimed is:

1. An impeller adapted for use in a centrifugal pump, said impeller comprising:
   - a hub for mounting said impeller for rotation;
   - an impeller shroud extending radially from said hub and having front and rear surfaces;
   - pumping vanes carried on said front surface and extending radially of said hub;
   - pump-out vanes carried on said rear surface and extending radially of said hub;
   - a repeller shroud extending radially from said hub and arranged in spaced facing relationship with said rear surface, said repeller shroud having an outer diameter less than outer diameters of said impeller shroud, said pumping vanes and said pump-out vanes, said repeller shroud cooperating with said rear surface and said pump-out vanes to define a plurality of radially extending and outwardly opening flow paths; and flow openings passing across said impeller shroud and communicating with said radially extending flow paths.

2. An impeller according to claim 1, wherein at least staggered ones of said pump-out vanes have inner ends spaced from said hub for placing a pair of said flow paths on annularly opposite sides of said staggered ones of said pumpout vanes in flow communication adjacent said hub, and at least one of said flow openings communicates with each of said pair of said flow paths.

3. An impeller according to claim 1, wherein said pump-out vanes have inner ends spaced from said hub for placing said flow paths in flow communication adjacent said hub.

4. An impeller according to claim 1, wherein said pump-out vanes have inner ends joined to said hub, and said flow openings communicate with at least alternate ones of said flow paths.

5. An impeller according to claim 1, wherein said flow openings have rear ends passing through said rear surface of said impeller shroud, and said outer diameter of said repeller shroud is disposed radially outwardly of said rear ends of said flow openings.

6. An impeller according to claim 1, wherein said pump-out vanes have radially extending free rear edges and said repeller shroud carries radially extending repeller vanes having radially extending free rear edges disposed rearwardly of said rear edges of said pump-out vanes.

7. An impeller according to claim 6, wherein said repeller shroud is disposed axially intermediate said rear edges of said pump-out vanes and said rear surface of said impeller shroud.

8. An impeller according to claim 1, wherein said pump-out vanes have radially extending free rear edges and said repeller shroud is disposed axially intermediate said rear edges and said rear surface of said impeller shroud.

9. An impeller according to claim 1, wherein said impeller shroud and pump-out vanes have outer diameters exceeding an outer diameter of said pumping vanes, said flow openings have rear ends passing through said rear surface of said impeller shroud, and said repeller shroud is radially outwardly bounded by an annular rim disposed radially outwardly of said rear ends of said flow openings.

10. An impeller according to claim 9, wherein said pump-out vanes have radially extending free rear edges and said repeller shroud is disposed axially intermediate said rear edges and said rear surface of said impeller shroud.

11. An impeller according to claim 10, wherein said repeller shroud carries repeller vanes having free radially extending rear edges disposed rearwardly of said rear edges of said pump-out vanes.

12. An impeller according to claim 11, wherein said repeller vanes are radially aligned with said pump-out vanes.

13. An impeller according to claim 1, wherein said pump-out vanes have rear edges joined to a further shroud cooperating with said rear surface and said pump-out vanes to define a further plurality of radially extending flow paths aligned with the first said flow paths, said further shroud being spaced radially outwardly of said repeller shroud.

14. An impeller according to claim 13, wherein said repeller shroud is radially aligned with said further shroud, and joined to said rear edges, and said further shroud carries a rearwardly extending choke flange disposed concentrically of said hub.

15. A centrifugal pump particularly adapted for pumping liquid having a gas content, said pump comprising:

a pump casing having a pumping chamber bounded in part by a rear wall surface, a suction inlet opening into said pumping chamber towards said rear wall surface and a discharge outlet opening radially into said pumping chamber;

an impeller mounted by a drive shaft for rotation within said pumping chamber intermediate said suction inlet and said rear wall surface, said impeller including an impeller shroud having a front surface facing towards said suction inlet and a rear surface facing towards said rear wall surface, pumping vanes carried adjacent said front surface for pumping liquid from said suction inlet towards said discharge outlet, pump-out vanes carried adjacent said rear surface, flow openings passing across said impeller shroud, and a repeller shroud spaced from said rear surface and cooperating therewith and said pump-out vanes to define radially extending flow paths, said flow openings having outlet ends communicating with said flow paths; and gas removal means communicating with said pumping chamber for withdrawing gas therefrom, said gas removal means including a vent chamber opening through said rear wall surface adjacent said pump shaft, and said repeller shroud constrains liquid passing through said outlet ends of said flow openings for flow radially outwardly along said flow paths before passing radially inwardly towards said vent chamber.

16. A pump according to claim 15, wherein said repeller shroud, said vent chamber, and said pump-out vanes have outer diameters of $D_R$, $D_{VC}$ and $D_{P02}$, respectively, and $D_{VC} \leqq D_R < D_{P02}$.

17. A pump according to claim 16, wherein said impeller shroud and said pumping vanes have outer diameters of $D_S$ and $D_2$, respectively, and $D_S$ and $D_{P02} \geqq D_2$..

18. A pump according to claim 17, wherein said pumpout vanes have free rear edges and said repeller shroud is disposed intermediate said free rear edges and said rear surface of said impeller shroud.

19. A pump according to claim 18, wherein an additional chamber opens through said rear wall surface concentrically of said vent chamber, and said repeller shroud carries repeller vanes projecting rearwardly beyond said free rear edges and into said additional chamber.

20. A pump according to claim 17, wherein said pumpout vanes have rear edges joined to a further shroud cooperating with said rear surface and said pump-out vanes to define a further plurality of radially extending flow paths aligned with the first said flow paths, said further shroud being spaced radially outwardly of said repeller shroud.

21. A centrifugal pump installation for handling a fibrous suspension having a gas content to be pumped from a reservoir containing such suspension, said pump installation comprising:

a centrifugal pump housing defining a pumping chamber bounded in part by a rear wall, a suction inlet opening towards said rear wall for placing said reservoir in flow communication with said pumping chamber and a discharge outlet disposed in radial flow communication with said pumping chamber and connected to a discharge conduit;

fluidizer means for fluidizing said suspension adjacent said suction inlet and tending to centrifugally separate said gas from said suspension for collection in a core area disposed centrically of said suction inlet;

an impeller supported for rotation within said pumping chamber by a drive shaft aligned with said suction inlet and passing through a drive shaft receiving opening in said rear wall, said impeller including a hub supported by said drive shaft, an impeller shroud extending radially from said hub and having front and rear surfaces facing towards said suction inlet and rear wall, respectively, pumping vanes carried by said front surface for pumping said suspension between said suction inlet and said discharge outlet, pump-out vanes carried by said rear surface, a repeller shroud extending radially from said hub and disposed in a spaced facing relationship to said rear surface, said repeller shroud cooperating with said impeller shroud and said pump-out vanes for defining radially extending flow paths, and flow openings having front ends arranged for communication with said core area and rear ends disposed in flow communication with said flow paths; and gas removal means for withdrawing gas tending to collect within said pumping chamber, said gas removal means including an annular vent recess formed in said rear wall about said drive shaft receiving opening and means for selectively withdrawing gas from said vent recess, wherein said repeller shroud, said vent recess, said pump-out vanes, said impeller shroud and said pumping vanes having outer diameters of $D_R$, $D_{VC}$, $D_{P02}$, $D_S$ and $D_2$, respectively, $D_R$ is equal to or greater than $D_{VC}$ and less than $D_{P02}$, $D_S$ and $D_2$, and $D_{P02}$ and $D_S$ are equal to or greater than $D_2$.

22. A pump installation according to claim 21, wherein $D_R$ is greater than $D_{VC}$, and $D_{P02}$ and $D_S$ are greater than $D_2$.

23. A pump installation according to claim 22, wherein said repeller shroud carries repeller vanes projecting rearwardly of said pump-out vanes, an additional annular recess is formed in said rear wall concentrically outwardly of said vent recess and receives said repeller vanes.

24. A pump installation according to claim 23, wherein said pump-out vanes have free rear edges, and said repeller shroud is disposed forwardly of said rear edges.

25. A pump installation according to claim 24, wherein said front and rear ends of said flow openings pass through said front and rear surfaces of said shroud, and said repeller shroud has a rim disposed radially outwardly of said rear ends.

26. A pump installation according to claim 22, wherein said pump-out vanes have free rear edges, and said repeller shroud is disposed forwardly of said rear edges.

27. A pump installation according to claim 26, wherein said front and rear ends of said flow openings pass through said front and rear surfaces of said shroud, and said repeller shroud has a rim disposed radially outwardly of said rear ends.

28. A pump installation according to claim 21, wherein said means for selectively withdrawing gas from said vent recess includes a vent conduit leading to a gas collection reservoir, a gas flow control valve arranged in said vent conduit intermediate said vent recess and said gas collection reservoir, and control means responsive to the height of said suspension in said reservoir for alternatively maintaining said gas flow control valve in fully open or closed conditions.

29. A pump installation according to claim 28, wherein said control means includes a liquid flow control valve disposed in said discharge conduit for adjustably controlling flow of liquid therethrough, sensing means for sensing said height of said suspension and a controller, said controller adjustably controlling the setting of said liquid flow control valve in response to variations in said height of said suspension as sensed by said sensing means, and said gas control valve is controlled by said controller to assume said fully open condition when said liquid control valve is set in a preselected partially open condition and said fully closed condition when said liquid control valve is set at less than said preselected partially open condition.

30. A pump installation according to claim 29, wherein said gas collection reservoir is the atmosphere and a vacuum pump is arranged in said vent conduit to withdraw gas from said vent recess through said gas control valve, said liquid flow control valve is operated to vary the flow of said suspension from said pump as to tend to maintain said suspension in said reservoir at a predetermined height about said suction inlet, and said suction pump is operated to produce a negative pressure in said vent chamber when said gas control valve is in said fully open condition, which creates a pressure differential across said pump when said suspension is at said predetermined height which exceeds the pressure differential required by the pump to maximize withdrawal of gas therefrom.

31. A pump installation according to claim 30, wherein said predetermined height is about five feet, said negative pressure is about ten feet of water, and said pump can withdraw gas from said suspension without loss of suspension through said vent conduit for suspension heights to at least ten feet.

32. A pump installation according to claim 31, wherein said control means causes said gas control valve to assume said fully closed condition when the height of said suspension within said reservoir produces a pressure differential across said pump at which said suspension is lost through said vent conduit.

* * * * *